US006865748B2

(12) United States Patent
Young

(10) Patent No.: US 6,865,748 B2
(45) Date of Patent: Mar. 15, 2005

(54) GUARD FOR PROTECTING PAINTER'S THUMB

(76) Inventor: Todd H. Young, 3839 E. Country Pl., Springfield, MO (US) 65809

( * ) Notice: Subject to any disclaimer, the term of this patent is extended or adjusted under 35 U.S.C. 154(b) by 0 days.

(21) Appl. No.: 10/081,781

(22) Filed: Feb. 20, 2002

(65) Prior Publication Data

US 2003/0154533 A1 Aug. 21, 2003

(51) Int. Cl.[7] ..... A41D 45/10
(52) U.S. Cl. ..... 2/21; 224/217; 294/25
(58) Field of Search ..... 2/16, 20, 21, 160, 2/163; 128/879, 880; 602/22; 220/755, 760; 294/25

(56) References Cited

U.S. PATENT DOCUMENTS 3,563,237 A * 2/1971 Maxwell ..... 602/58
5,092,481 A * 3/1992 Skelton ..... 220/752
5,471,681 A * 12/1995 Ferrini ..... 2/160
5,554,076 A * 9/1996 Clark ..... 473/61
5,570,807 A * 11/1996 Busch ..... 220/756
5,692,236 A * 12/1997 Prince ..... 2/21
5,770,297 A * 6/1998 Grubich ..... 428/99
6,049,022 A * 4/2000 Tseng et al. ..... 602/41
6,279,168 B1 * 8/2001 Bean ..... 2/209.13

* cited by examiner

*Primary Examiner*—Katherine Moran
(74) *Attorney, Agent, or Firm*—Scott J. Anchell

(57) ABSTRACT

The present invention comprises a thumb guard and method of protecting tissues of the thumb and hand from injury. A preferred thumb guard according to the present invention comprises a tubular tapered body made from a strap of flexible, resilient material in which the end segments are interconnected and oppositely inclined so that the guard will fit complementally over the user's thumb. The guard is configured so that when placed on a user's thumb, portions of the guard cover the metacarpophalangeal joint of the thumb to protect the thumb from stress and injury when the user holds a paint bucket with the thumb hooked under the bail of the bucket. The body is fabricated of sufficiently flexible material to permit fold back of the overlapping end segments of the strap body to permit orientation of the guard on the user's thumb in an alternate disposition such that the folded back segments of the guard protect the user's thumb pad from bail imposed stress when holding a paint bucket with the thumb hooked over the bail of the bucket.

10 Claims, 2 Drawing Sheets

FIG. 1.
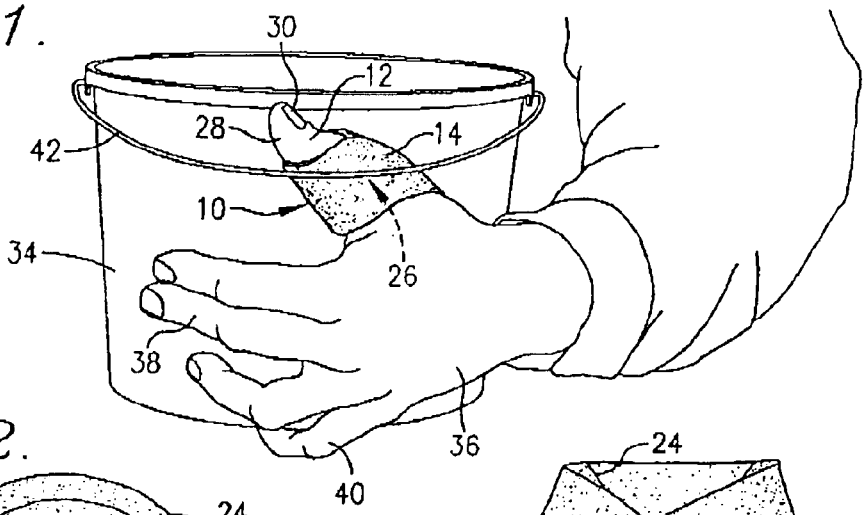
FIG. 2.
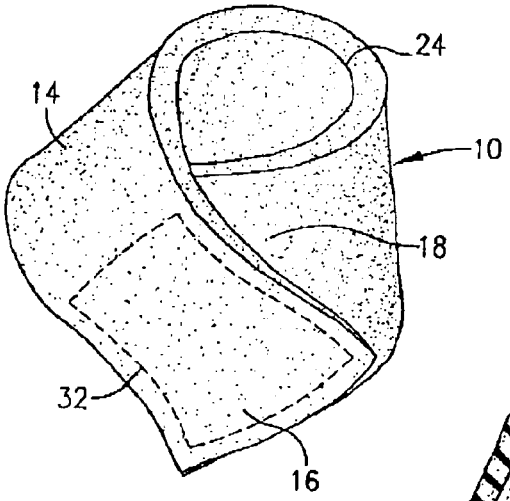
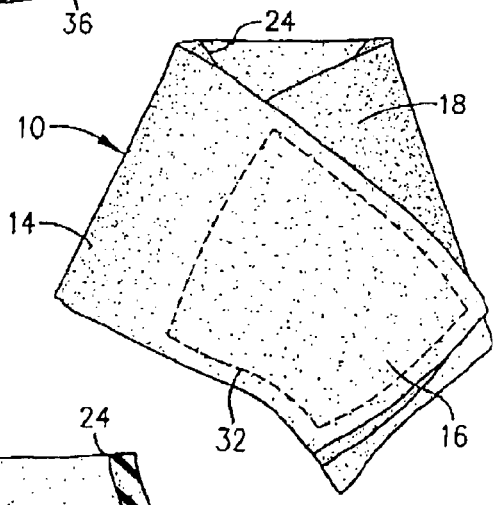
FIG. 3.
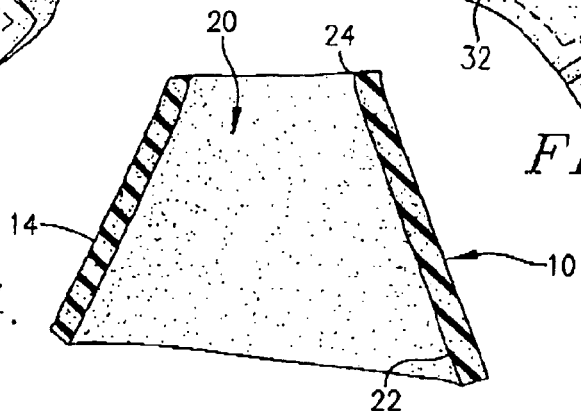
FIG. 4.
FIG. 5.
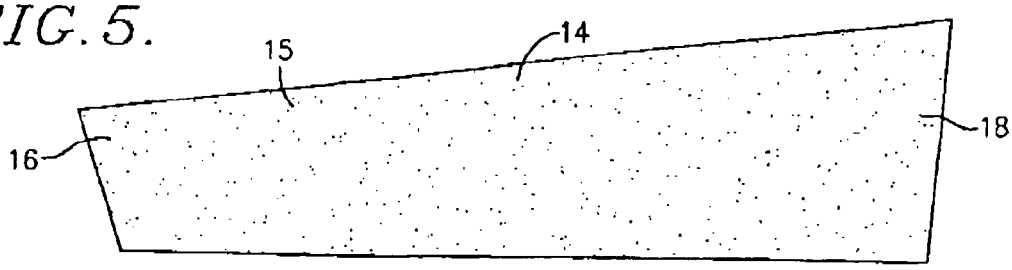

GUARD FOR PROTECTING PAINTER'S THUMB

BACKGROUND OF THE INVENTION

1. Field of the Invention

This invention generally relates to a thumb guard and method of protecting tissues of the thumb and hand from injury. The invention is particularly useful for persons whose activities require prolonged use of the thumb in handling various objects, such as a painter holding a paint bucket for long periods of time in a secure position with his thumb hooked under or over the bucket for stability for the paint bucket while the user's fingers engage the bucket.

2. Description of the Prior Art

Guards have been known to protect portions of the hand including the thumb from injury during various activities. One example is U.S. Pat. No. 6,012,165 to Cain which discloses a rigid thumb guard made of metal or a durable composite material of sufficient strength to protect a thumb from a hammer blow.

U.S. Pat. No. 5,517,692 to Wunderlich-Kehm discloses a specially configured thumb protector designed to provide a manicurist with protection against chafing irritation or injury from repeated contact with a nail file, or emory board.

The guards described above serve as some protection to prevent a person's thumb from being contacted by objects that may damage the skin and thumbnail. These guards do not protect the subcutaneous tissues of the thumb and hand from the stress of constant pressure that can cause injuries.

A number of muscles and ligaments cooperate within the thumb to allow for a wide range of motion. Such muscles and ligaments include the ulnar collateral ligament of the thumb, the first dorsal interosseous muscle, the opponens pollicis muscle, the adductor pollicis muscle, and abductor pollicis brevis muscle. These muscles and ligaments are generally located in the palmar region of the hand between the thumb and wrist. Sustained, prolonged force and pressure against the area of the thumb may place much stress on the tissues and cause residual pain and even protracted injury.

In addition to muscle and ligament damage, damage to the skin, subcutaneous tissue, radial digital vein, artery and nerve and to the joint capsule of the metacarpal phalangeal joint is also a risk due to stress brought on by sustained, prolonged, narrowly focused pressure against certain areas of the thumb.

Therefore, there is a real need in the art for a thumb guard which not only provides cushioned protection for the dermal areas of the thumb from abrasive-type injuries, but also provides protection from stress-related, deep tissue injuries when the thumb is exposed to prolonged periods of use, such as occurs when a painter holds a paint bucket with the thumb being used to engage the bucket bail in order to stabilize support of the bucket.

SUMMARY OF THE INVENTION

The present invention overcomes the above problems and provides a thumb guard and method of protecting the surface as well as deeply embedded muscles ligaments and nerves, tissues of the thumb and hand from injury. A thumb guard according to the invention allows for exposure of at least a portion of the thumb tip, thereby allowing the user to benefit from the sensitivity of the thumb pad and nail.

A preferred thumb guard according to the invention comprises a tubular body presenting a tapered, open-ended, thumb receiving passageway. The body is preferably formed from a resilient, flexible material and may be in the form of a strap presenting interconnected, opposed end segments folded together in an overlapping relationship. The body is also preferably slidably attachable and detachable from the thumb.

The passageway has a relatively large open end and an opposed, relatively small open end. The guard is configured so that when placed on a thumb by passing the thumb into the passageway through the relatively large open end, portions of the guard proximal the relatively large open end cover the metacarpophalangeal joint of the thumb, while the thumb pad and thumbnail are uncovered and in spaced relationship to the relatively small open end.

The thumb guard maybe made out of any flexible, resilient material that allows the guard to slide on and off of the thumb with relative ease. Preferably, the flexible material is padded and has a thickness of the order of from about ⅛ "to about ¼", and more particularly about 3⁄16". One especially preferred material is NEOPRENE®, comprising a layer of cellular foam integrally adhering to a relatively thin, flexible somewhat stretchy woven fabric.

When the body of the guard comprises a strap, it is preferable that the strap have a length of between about 4.5 to 6 inches, and more preferably about 5 inches. It is preferable that the widest portion of the strap have a width of about 1.5–2 inches and that the narrowest portion have a width of about 0.75–1.25 inches. However, it is preferable that the width of the strap not vary by more than a factor of two across the entire length.

Furthermore, when the body of the guard comprises a strap, the end segments of the strap preferably overlap each other. Although the end segments may overlap in any manner, it is preferred that the end segments overlap left over right in oppositely inclined relationship, based upon orientation with respect to the user. The end segments may be fastened to each other using any means commonly known in the art such as a snap or a plurality of hooks and looped pile material such as VELCRO®. However, it is preferable that the end segments be fixedly secured together by a plurality of stitches.

A preferred method of protecting tissues of the thumb and hand according to the invention comprises providing a tubular, tapered body formed of flexible, resilient material defining a tapered, open-ended, thumb-receiving passageway having a relatively large open end and an opposed, relatively small open end. The flexible body may be any body constructed as described above. The thumb to be protected is then placed in the passageway, and the body is oriented with respect to the thumb such that portions of the guard body cover the metacarpophalangeal joint of the thumb leaving the thumb pad and thumbnail uncovered and in spaced relationship from the relatively small open end.

The guard is constructed of sufficiently flexible material that the interconnected end segments of the tubular tapered body may be folded back to provide a double thickness layer. The guard may be placed over a user's thumb with the folded back portion thereof against the thumb joint and adjacent area of the thumb to protect the user's thumb joint and an adjacent portion of the user's thumb from excessive forces and stresses when the user holds a bucket with the thumb hooked over the bail of the bucket.

BRIEF DESCRIPTION OF THE DRAWINGS

FIG. 1 is a perspective view demonstrating a preferred thumb guard worn by the user while holding a bucket with his fingers while his thumb is hooked under the bail of the bucket;

FIG. 2 is a top end view of a preferred thumb guard;

FIG. 3 is a front perspective of a preferred thumb guard;

FIG. 4 is a cross-sectional view of a preferred thumb guard;

FIG. 5 is plan view of the elongated, flexible strap material from which the guard is fabricated;

DETAILED DESCRIPTION OF THE PREFERRED EMBODIMENT

Figure 6:
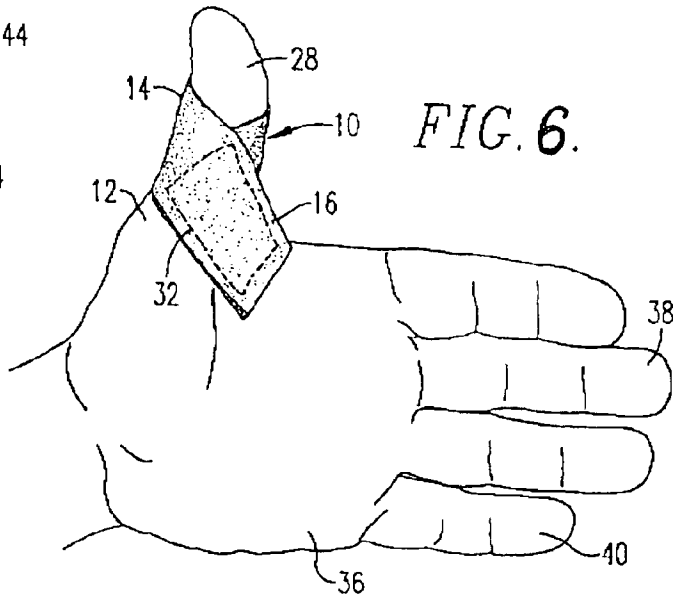
FIG. 6 is a front elevational view of the guard positioned on a user's thumb with the interconnected, overlapping, inclined end segments of the guard on the inside of the user's thumb.

The following description sets forth a preferred embodiment of the invention. It is to be understood, however, that this description is provided by way of illustration and nothing therein should be taken as a limitation upon the overall scope of the invention.

FIG. 1 shows a preferred embodiment of a thumb guard 10 according to the invention positioned on the left thumb 12 of a user. As shown in FIGS. 1–3, the thumb guard 10 comprises a body 14 of flexible, resilient, padded material of constructions as described in detail above. More specifically, the body 14 comprises an elongated trapezoidal strap 15 (FIG. 5) presenting a narrow end segment 16 and a wider end segment 18 at opposite ends of the strap 15 between segments 16 and 18. End segments 16 and 18 are folded over one another in overlapping relationship and are preferably fixedly interconnected. As shown in FIG. 3, end segment 16 is folded on top of end segment 18, however guards in accordance with the invention may comprise a strap where end 18 is folded on top of end 16.

The folded end segments 16, 18 are oriented in oppositely inclined relationship with respect to one another as best illustrated in FIGS. 2 and 3 of the drawings to define a tapered, open-ended thumb-receiving passageway 20. The passageway 20 has a relatively large open end 22 and an opposed, smaller open end 24. When the guard 10 is placed on the thumb 12, the thumb 12 passes into passageway 20 through the relatively large open end 22. Portions of the guard 10 proximal to the relatively large open end 22 cover the metacarpophalangeal joint 26 of the person's thumb. When in proper position on the thumb 12, portions of the thumb pad 28 and thumbnail 30 are uncovered and in spaced relationship from the relatively small open end 24.

As depicted in FIGS. 2 and 3, end segments 16, 18 are preferably permanently, fixedly secured by a plurality of stitches 32. However, as disclosed above, the end segments 16, 18 may be secured together, fixedly or separably, by any commonly known means.

It can therefore be seen that the thumb guard body 14 is of generally conical oppositely inclined configuration which complementally engages a user's thumb which increases in size as the palm is approached. An advantage of guard 10 is the fact that when placed over a user's thumb in the disposition shown in FIG. 2, the overlapping end segments 16, 18 present a double layer of flexible material for more effectively protecting sensitive areas of the user's thumb.

When the thumb guard 10 is worn by a user who is holding a relatively heavy object for prolonged periods of time, such as a paint bucket 34 with his middle fingers 38 engaging the sides of the bucket 34 and his little finger 40 hooked under the bottom of bucket 34, while the user's thumb 12 is hooked under the bail 42 of the bucket to stabilize the bucket, the guard 10 is effective in controlling and preventing damage to tissues of the thumb 12 and hand 36 and especially the metacarpophalangeal joint 26 and adjacent areas of the thumb.

Although holding a paint bucket in a manner as shown in FIG. 1 is a conventional and widely employed method used by many professional painters, doing so for many hours at a time day after day can have serious adverse consequences on the painter's thumb causing protracted pain and even irreversible injury to those areas of the person's thumb referenced in detail above. Rest and relaxation by setting the bucket down for long periods of time simply is not an option for professional painters who are compensated on a time or job quote basis.

Not only does the guard 10 protect the skin and outer tissues of the thumb 12 from abrasion, the guard 10 also and especially inclined overlapping ends 16, 18 protect various subcutaneous tissues from injury as a result of sustained, heavy, line pressure stress. Prolonged engagement of the thumb 12 may place undue stress on the radial side nerve resulting in pain. Pressure stress on the digital vein and artery of the thumb may reduce blood flow to the thumb resulting in numbness and decreased blood circulation. The guard 10 also relieves pressure stress on the joint capsule of the metacarpophalangeal joint and the muscles and ligaments of the thumb. The guard 10 acts to relieve pressure stress placed upon the collateral ligament of the thumb, the first dorsal interosseous muscle, the opponens pollicis muscle, the adductor pollicis muscle and the abductor pollicis brevis muscle thereby reducing fatigue of these tissues.

Figure 7:
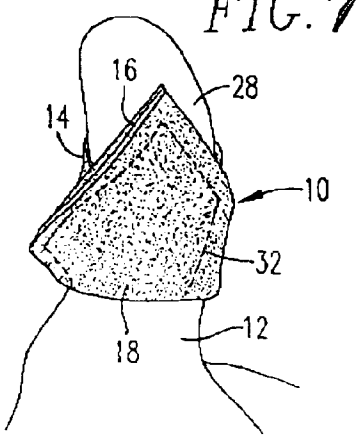
FIG. 7 is a front elevational view of the guard positioned on a user's thumb as depicted in FIG. 6, but with the inclined end segments of the guard folded back on one another.
Figure 8:
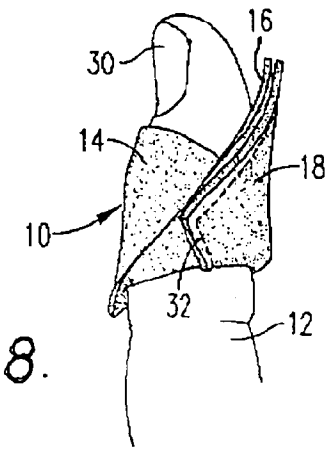
FIG. 8 is a side elevational view of the guard as shown in FIG. 7 illustrating the position of the folded back end segments of the guard in relationship to the user's thumb.
Figure 9:
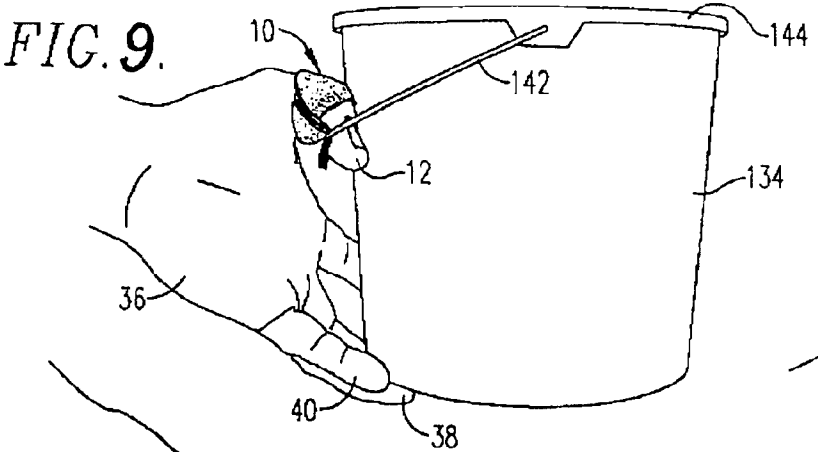
FIG. 9 is a perspective view of the manner in which the guard as illustrated in FIGS. 7 and 8, having folded back end segments may be advantageously employed by a user to hold a bucket with his fingers underlying the bucket, while his thumb is hooked over the bail of the bucket below the rim of the bucket.

Alternate uses of guard 10 are illustrated in FIGS. 7–10. The material making up strap 15 from which the guard 10 is fabricated is preferably of sufficient flexibility that when placed on the user's thumb 12 in disposition as shown in FIG. 7 with overlapping segments 16 and 18 facing toward the user's palm, end segments 16 and 18 may readily be turned folded back on one another as shown in FIGS. 7 and 8 so that the double folded portions of the guard 10 directly overlie the thumb pad 28 of the user's thumb 12 opposite the user's thumb nail 30.

Certain paint professionals hold a paint bucket 134 or the like with their middle fingers 38 underlying the bucket 34 while their little finger 40 lies along the upright surface of the bucket adjacent the bottom thereof. In this instance, the person's thumb 12 is hooked over the pail 142 which is located below the rim 144 of bucket 134. It is to be seen that holding a bucket in this manner imposes significant stresses on the user's thumb joint and the underside of the user's thumb where the thumb pad 28 merges with the main body of the person's thumb.

When guard 10 is positioned on a user's thumb with the end segments 16 and 18 folded back on one another to present multi-layer padding as shown in FIGS. 7 and 8, the person's thumb joint and adjacent tissues are protected from undue stress and attendant stress and/or injury.

Figure 10:
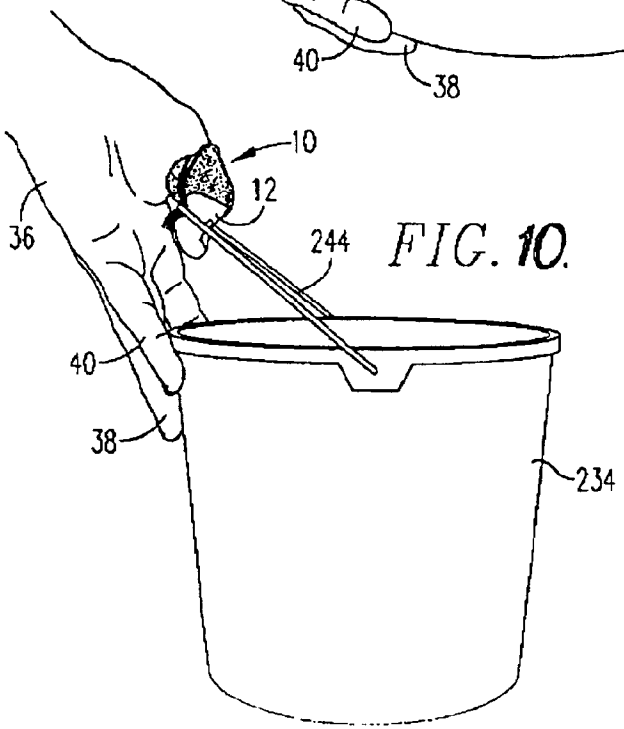
FIG. 10 is a perspective view of an alternate use of the guard as shown in FIGS. 7 and 8, with folded back end segments in which the bucket is held by the fingers against the rim portion of the bucket while the user's thumb is hooked under the bail above the bucket.

Similarly, in those cases where paint professionals hold a paint bucket 234 as shown in FIG. 10 with their fingers 38 resting against the top part of the bucket while the user's thumb 12 is hooked over the bail 244 positioned above the top of the bucket, again it can be seen that significant forces are applied to the thumb pad of the person and adjacent inner parts of the thumb. Use of the guard 10 with end segments 16 and 18 folded back as shown in FIGS. 7 and 8 significantly lessens application of undue deleterious pressures to the thumb which is noted can cause injury and/or undesirable nerve, muscle and tissue impingement.

The end segments 16 and 18 of guard 10 may be folded back against the remainder of the body 14 in a manner FIGS. 7 and 8 either before the guard 10 is applied to the user's thumb or after insertion of the guard 10 over the user's thumb. The latter procedure is preferred because of the ease of placing the guard over the person's thumb prior to folding of body 14 and then followed by fold back of the end segments 16 and 18 as illustrated in the drawings.

I claim:

1. A thumb guard comprising a tubular, tapered body formed of flexible, resilient material, said body defining a tapered, open-ended, thumb-receiving passageway having a relatively large open end and an opposed, relatively small open end, said guard configured so that when placed on a thumb by passing the thumb into said passageway through said relatively large open end, end portions of the guard proximal said relatively large open end are oriented relative to one another in an oppositely inclined relationship so as to present a double layer of the flexible, resilient material to cover and protect the metacarpophalangeal joint of the thumb from undue stresses.

2. The thumb guard of claim 1, said body formed from a padded flexible fabric material.

3. The thumb guard of claim 2, said padded flexible fabric material having a thickness of less than about ¼".

4. A method of protecting tissues of the thumb and hand while a person holds a paint bucket having a bail and comprising:

providing tubular, tapered body formed of flexible, resilient material, said body defining a tapered, open-ended, thumb-receiving passageway having a relatively large open end and an opposed, smaller open end, defined in part by oppositely inclined, overlapping, interconnected end segments joined to a central segment, said body configured to generally complementally receive a person's thumb so that when placed on a thumb by passing the thumb into said passageway through said relatively large open end;

inserting a thumb to be protected into said passageway through the large open end thereof; and orienting said body with respect to said thumb with portions of the body in generally covering protecting relationship to the metacarpophalangeal joint of the thumb to protect the thumb and said joint from undue stresses while the user holds a bucket with the thumb hooked under the bail of the bucket.

5. The method of claim 4, said flexible body comprising a padded flexible material.

6. The method of claim 5, said padded flexible material having a thickness of about ⅛" to about ¼".

7. The method of claim 4 said end portions being secured by a plurality of stitches.

8. The method of claim 4, said strap having a width that does not vary more than by a factor of two.

9. A thumb guard for protecting a person's thumb while the individual holds a bucket provided with a swingable bail, said guard comprising an elongated strap of flexible, resilient material presenting a body having a central segment and a pair of opposed end segments integral with the central segment, said end segments being folded together in oppositely inclined overlapping relationship and interconnected to define a tapered, open ended passageway having a relatively large open end and an opposed smaller open end, said guard being configured to generally complementally accept a user's thumb by passing the thumb into said passageway through said relatively large open end in an orientation such that a portion of the body covers the metacarpophalangeal joint area of the thumb to protect such area from excessive force when the user holds a bucket with fingers under the bucket and the thumb is positioned beneath the bail to stabilize the bucket, said strap being sufficiently flexible such that the overlapping, interconnected end segments of the guard may be folded back so that when the guard is placed over a user's thumb by passing the thumb into said passageway through the larger end of the guard with the folded back portion of the body oriented adjacent the joint and thumb pad of a person's thumb, the guard protects the portion of the thumb pad of a user's thumb underlying the double folded portion of the guard from excessive stress while the user holds a bucket with fingers engaging the bottom portion of the bucket and the thumb is hooked over the bail.

10. A method of protecting tissues of a person's thumb from excessive stress while holding a bucket provided with a swingable bail, said method comprising the steps of:

providing a tubular, tapered body formed of flexible resilient material having a central segment and a pair of opposed end segments integral with the central segment, said end segments being folded together in oppositely inclined overlapping relationship and interconnected to define an open ended passageway configured to complementally receive a person's thumb and having a relatively large open end and an opposed smaller end, said strap being sufficiently flexible that the overlapping ends of the guard may be folded back to provide a double thickness of material; and inserting a thumb into the passageway through the large end thereof with overlapping ends of the strap folded back oriented generally in disposition adjacent the person's thumb pad opposite the thumb nail so that the guard serves to protect the person's thumb joint and adjacent portions of the thumb pad from excessive stress when a bucket is held with fingers engaging the bucket and the thumb is hooked over the bail.

* * * * *